US005368715A

United States Patent [19]

Hurley et al.

[11] Patent Number: 5,368,715

[45] Date of Patent: Nov. 29, 1994

[54] METHOD AND SYSTEM FOR CONTROLLING PLATING BATH PARAMETERS

[75] Inventors: Michael P. Hurley, Clinton, Conn.; Stephen J. Boezi, Coventry, R.I.

[73] Assignee: Enthone-Omi, Inc., Warren, Mich.

[21] Appl. No.: 24,203

[22] Filed: Feb. 23, 1993

[51] Int. Cl.[5] ..... C25D 21/14; C25D 17/00; B05C 11/00

[52] U.S. Cl. ..... 205/82; 205/101; 204/232; 204/275; 427/8; 118/666; 118/708; 118/712

[58] Field of Search ..... 205/81-82, 205/99-101; 204/1.11, 275, 232; 427/8; 118/666, 708, 712

[56] References Cited

U.S. PATENT DOCUMENTS

| | | | |
|---|---|---|---|
| 3,649,509 | 3/1972 | Morawetz et al. | 204/275 X |
| 4,045,304 | 8/1977 | Tezuka | 205/81 |
| 4,674,440 | 6/1987 | Cardin et al. | 118/688 |
| 4,814,197 | 3/1989 | Duffy | 427/8 |
| 4,886,590 | 12/1989 | Tittle | 204/232 |
| 5,182,131 | 1/1993 | Hashimoto et al. | 427/8 |

FOREIGN PATENT DOCUMENTS

| | | | |
|---|---|---|---|
| 0091396 | 5/1986 | Japan | 205/82 |

OTHER PUBLICATIONS

Process Control of Electroplating Solutions by Predictive Model Control, Published Oct. 1990.

Process Control in Tin and Tin-Leading Plating of Contacts, Hurley et al., "Electronic Manufacturing", Jan. 1990.

Process Control in Automatic Tab Plating, Circuitree Magazine, Jul. 1990.

Statistical Process Control for Electronics Electroplating Applications, by John Lovie, Technical Manager and Kathleen Miscioscio, Marketing Specialist Sel-Rex, Jan. 1986.

Consistent Contact Performance Through Improved Process Control, by John Lovie, Technical Manager and Kathleen Miscioscio, Marketing Specialist, Sel--Rex. Nov. 1985.

*Primary Examiner*—Donald R. Valentine

*Attorney, Agent, or Firm*—Wegner, Cantor, Mueller & Player

[57] ABSTRACT

The present invention is directed to an expert control system for controlling plating bath parameters. The system uses both feed-forward and feed-backward control to determine the amount and timing of replenisher additions of bath constituents to maintain optimum bath efficiency.

20 Claims, 7 Drawing Sheets

METHOD AND SYSTEM FOR CONTROLLING PLATING BATH PARAMETERS

FIELD OF THE INVENTION

The present invention is an expert control system for controlling the parameters of a plating bath and, more particularly, for controlling the parameters of a plating bath using both feed-forward and feed-backward control. The present invention is particularly useful to control hard gold plating baths.

BACKGROUND OF THE INVENTION

In metal plating processing, the bath constituents change as the plating process proceeds, either because certain constituents are depleted, or because of product drag-out, that is, a certain amount of plating solution is carried out of the bath as the plated products are removed. The drag-out varies depending on the shape and size of the plated products. Moreover, the bath can become contaminated over time, and/or the pH of the bath can change.

The conventional response to this problem is to have an operator manually replenish bath constituents based on a predetermined replenishment schedule. However, such a schedule does not account for changes peculiar to a particular bath. As a result, it is difficult to ensure a consistent plating thickness and consistent quality from one plating run to another. Moreover, as a practical matter, the bath constituents cannot be replaced as often as is necessary to ensure constant bath composition.

Accordingly, it is necessary for a manufacturer of plated goods to use a target plating thickness greater than the customer's specification in order to provide a margin which will allow for variations in the plating thickness. This is extremely inefficient and can result in unnecessary added expense. This expense can become very significant when plating with precious metals.

Moreover, many customers are requiring that their suppliers have quality control processes in place. With conventional processing, it is impossible to ensure the six-$\sigma$ (a standard deviation of 0.000001) plating accuracy required by many customers. Plating companies may lose customers if they cannot meet six-$\sigma$ quality control requirements.

SUMMARY OF THE INVENTION

The present invention overcomes the above disadvantages by providing an expert control system using both feed-forward and feed-backward control. The feed-backward control relies on sensor inputs relating to constituent concentrations, plating efficiency, current output from the rectifier, drag-out rate, plating solution volume/liquid level, temperature and plating thickness.

The feed-forward control relies on a predictive model. In an electroplating process, for example, the changes in composition of the plating bath due to anode and cathode reactions are quantitatively modeled as a function of current-time. Additionally, the changes through drag-out are also modeled as a function of current-time. These are combined to obtain an overall system model. Materials or mass balance equations are applied to the model to calculate replenishment as a function of current-time to compensate precisely for the losses and to maintain constant bath composition.

A microprocessor compares the sensor signals obtained by the feed-backward control sensors against set points obtained by the predictive model and control/-tolerance limits. If the values exceed the control/tolerance limits, the system can (1) recommend additional replenisher additions; (2) recommend postponing upcoming feed-forward additions for a determined period of ampere-time; and/or (3) assist the user in bringing the bath parameters back into their desired ranges via diagnostic screens.

The present invention allows plating processes to be controlled to six-$\sigma$ accuracy, thus reducing the amount of plating materials used. When plating precious metals such as gold, this can result in a substantial savings for the metal-plating manufacturer.

BRIEF DESCRIPTION OF THE DRAWINGS

Various aspects of the present invention can be best understood in reference to the attached Figures, wherein.

DETAILED DESCRIPTION OF THE PREFERRED EMBODIMENTS

Figure 1:
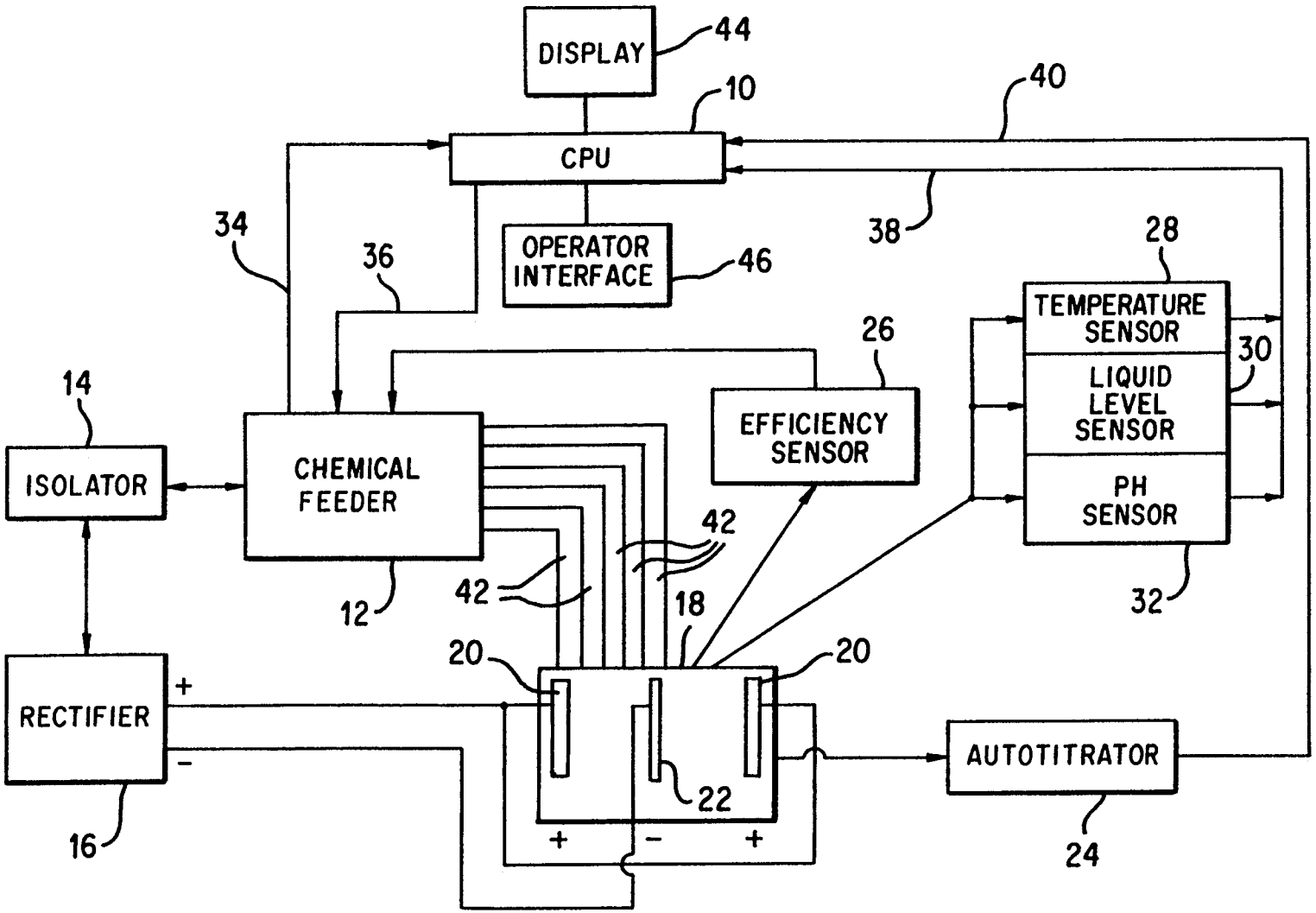
FIG. 1 is a schematic drawing of the expert control system according to a preferred embodiment of the present invention.

An expert control system for controlling the parameters of a plating bath according to a preferred embodiment of the present invention is schematically shown in FIG. 1. Within the context of this application, the term "parameter" refers to any quantifiable variable of the plating process, including, but not limited to, the temperature of the plating bath, the liquid level of the plating bath, the pH of the plating bath, the concentration of any constituent of the bath, and the like. It is further understood that the present invention may be applied to any plating processes, including electroplating using soluble or insoluble anodes, or electroless plating processes.

CPU 10 is operatively coupled to a chemical feeder 12 via lines 34 and 36, such as an RS422 data bus. The feeder includes reservoirs of the bath constituents (not shown) and a pump (not shown) for feeding replenishment materials from the appropriate reservoir through lines 42 into plating tank 18, as discussed in more detail below. Rectifier 16, which provides the plating current to electrodes 20, 22, is coupled via isolator 14 to the chemical feeder.

Efficiency meter 26 measures the efficiency of the plating bath and inputs the efficiency reading to the chemical feeder. Such efficiency meters are known, for example, it is envisioned that an off-the-shelf unit from Maxtek Inc. may be used. The efficiency and rectifier inputs are fed from the chemical feeder to the CPU via line 34. Alternatively, these inputs may be sent directly from the rectifier and efficiency meter to the CPU.

Samples of the bath are taken and analyzed in autotitrator 24. It is envisioned that the autotitrator may be, for example, an off-the-shelf unit such as is available from Orion Research Corporation. The bath samples may be taken manually, or it is envisioned that they may be taken automatically. The results of the autotitrator showing the concentration of selected bath constituents are input to the CPU via line 40.

It is also envisioned that other bath parameters may be measured. For example, temperature sensor 28, liquid level sensor 30 and pH sensor 32 may be coupled to bath 18 and the data therefrom input to the CPU via line 38. Alternatively, the sensor data from sensors 28, 30, 32 may be input to CPU 10 via chemical feeder 12. If a particular plating process is affected by parameters not already accounted for in the standard system of the present invention, additional sensors may be added as needed. The sensor input 38 may originate from either analog or digital sources. However, if an analog sensor is used, an analog-to-digital converter (not shown) should be used at the analog source.

Certain plating processes may not need all bath parameters to be monitored. For example, in hard gold plating processes, it has been determined that monitoring pH, temperature and bath volume (liquid level), while periodically measuring bath efficiency and gold concentration may provide sufficient information to adequately determine whether the plating reactions are proceeding properly. However, continuous monitoring and updating of all of the bath components is preferred as it will provide the most accurate control of the composition of the plating bath. While pH, temperature, liquid level and specific gravity of the plating solution are monitored and controlled, the following table lists examples of various additional parameters that may be monitored and controlled for various electrolytic plating solutions:

| Type of Plating Solution | Desired Parameters to be Measured (concentration of:) |
|---|---|
| Hard Gold | Metals, acids, spectator ions. |
| Acid Copper | Copper metals, acid, chloride, organic brightener and/or grain refiners. |
| Tin/Lead | Metals, acid, organic brighteners and/or grain refiners. |
| Palladium/Nickel | Metals, brighteners, stress reducers. |
| Nickel | Nickel metal, boric acid, halogen anode activator, sulfates, sulfamates, brighteners and/or stress reducers. |

CPU 10 is programmed so as to calculate a predictive model for the changes in the composition of a plating bath. A predictive system model is calculated based on changes caused by the anode and cathode reactions and the changes caused by drag-out, both as a function of current-time (e.g., ampere-minutes). The overall predictive system model thus predicts constituent consumption as a function of current-time. Using material balance or mass balance calculations, the amount of replenisher additions needed to compensate for constituent losses can be predicted so as to keep the bath composition fairly constant. This is the "feed-forward" side of the expert control system according to the present invention.

The output of the various sensors, such as the efficiency sensor, the autotitrator, the temperature sensor, the liquid volume sensor and the pH sensor allow for "feed-backward" control of the composition of the plating bath. For example, if the predictive model for drag-out is slightly inaccurate, the plating bath will tend to drift out of control. Input from the feed-backward side of the expert control system according to the present invention allows the predicted replenisher additions to be modified to compensate for minor inaccuracies in the predictive model or for other factors such as contamination, operator error or the like.

The CPU compares the sensor signals against set points determined by the predictive model and control/tolerance limits set by the operator. If the values exceed the control/tolerance limits, the system can (1) recommend additional replenisher additions; (2) recommend postponing upcoming feed-forward additions for a determined period of ampere-time; and/or (3) assist the user in bringing the bath parameters back into their desired ranges via diagnostic screens.

Figure 2:
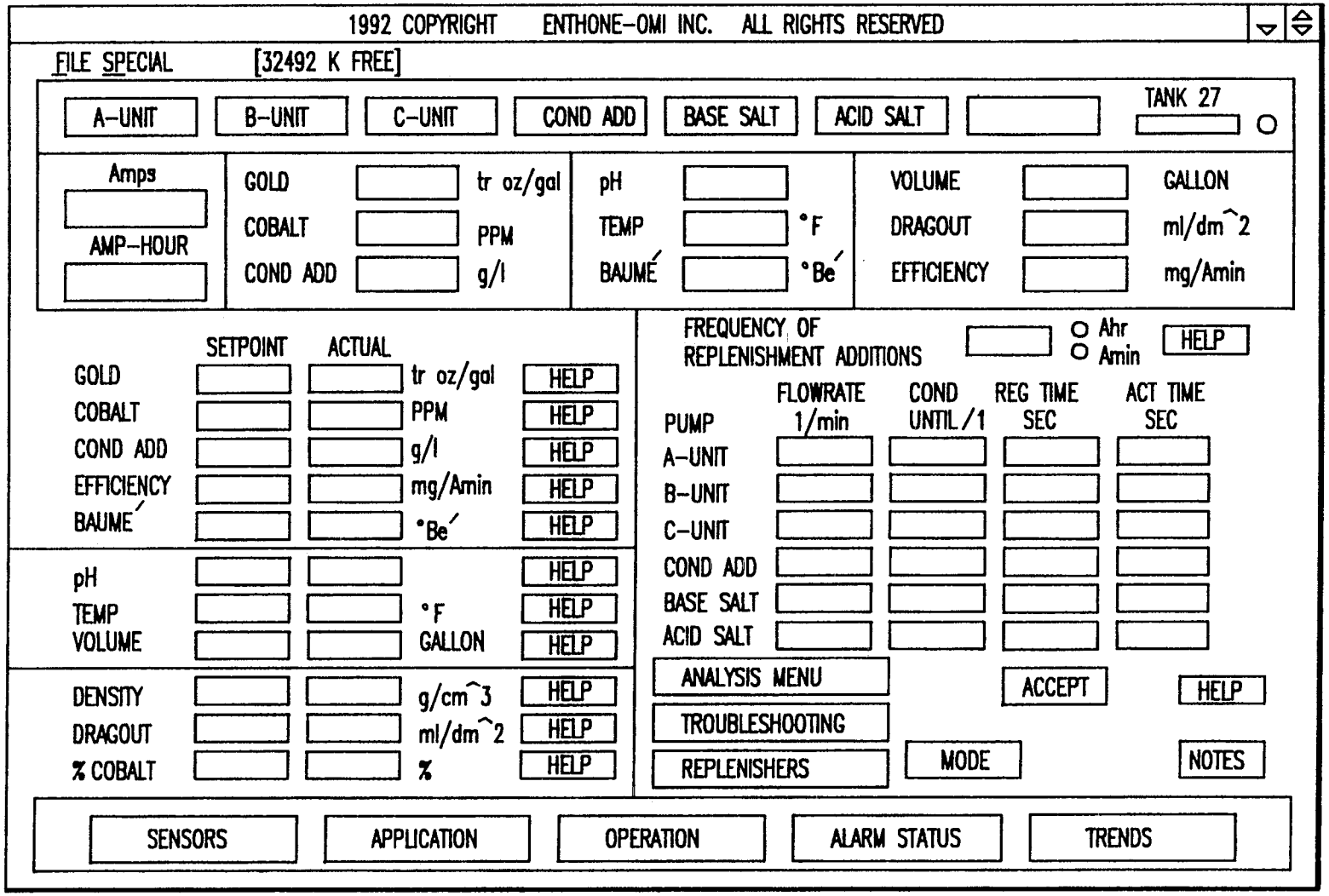
FIG. 2 shows a sample operator display for a hard gold plating process.
Figure 3:
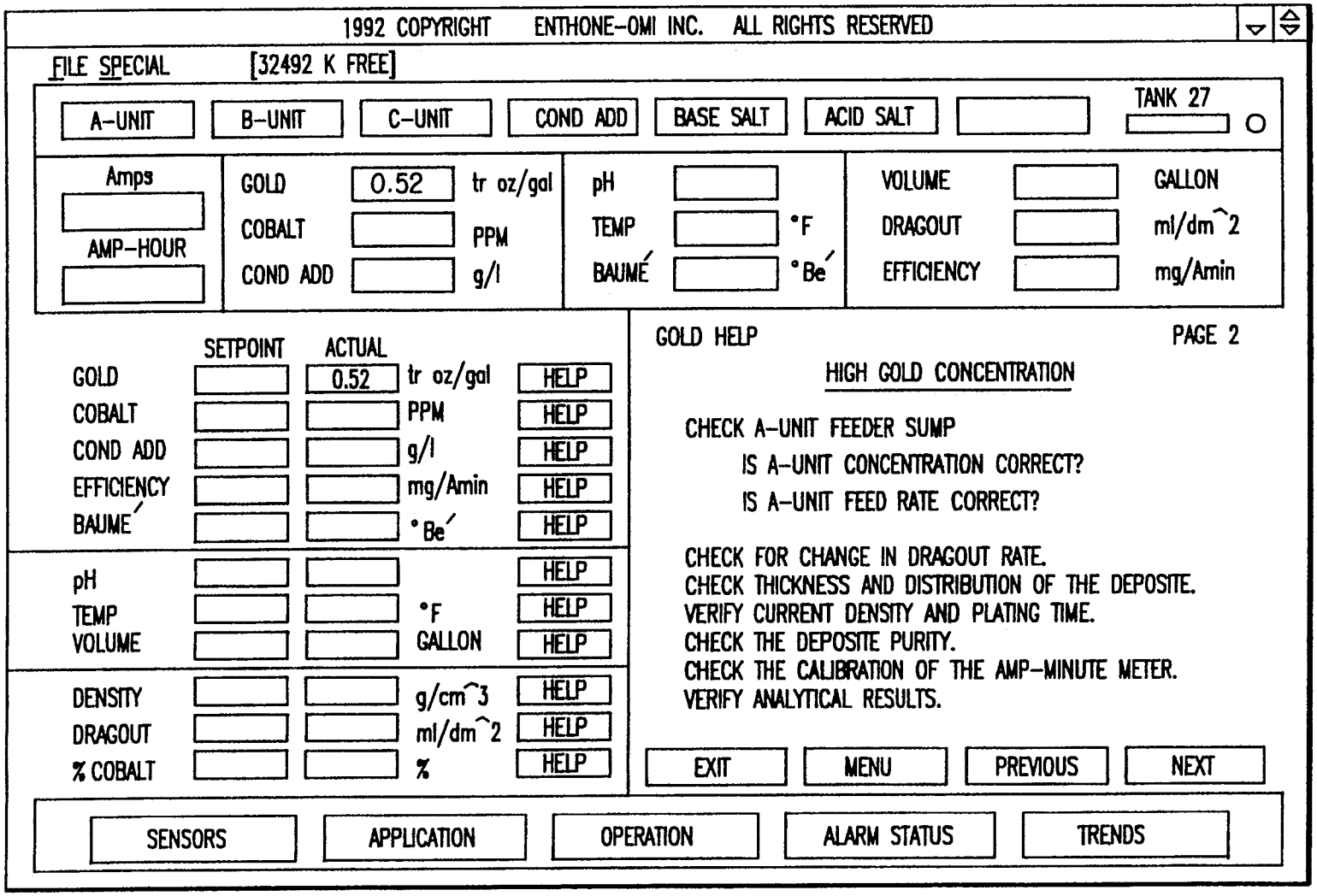
FIGS. 3 shows a sample diagnostic screen for a hard gold plating process when the gold concentration is too high.
Figure 4:
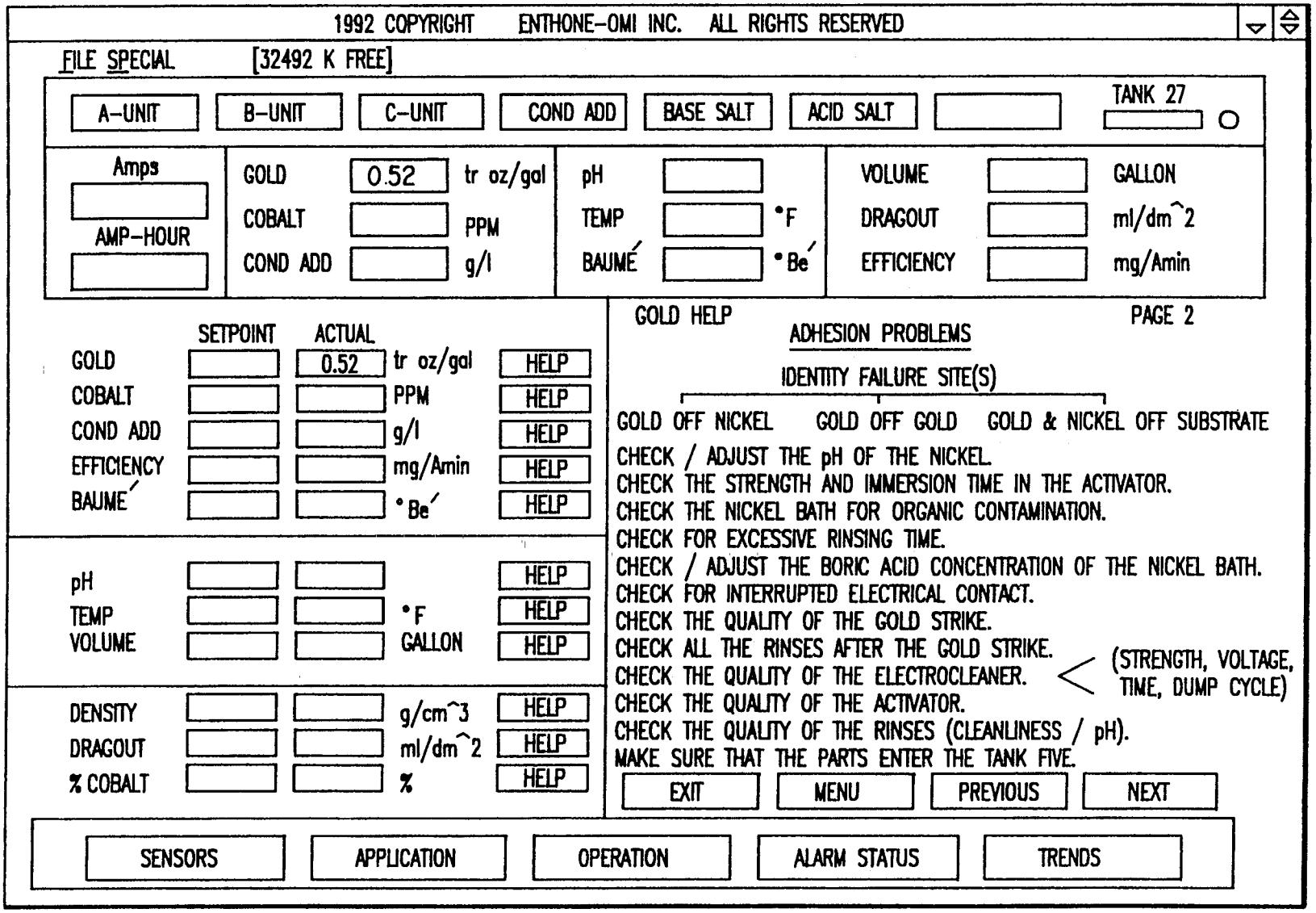
FIG. 4 shows a sample diagnostic screen for a hard gold plating process when there are adhesion problems.
Figure 5:
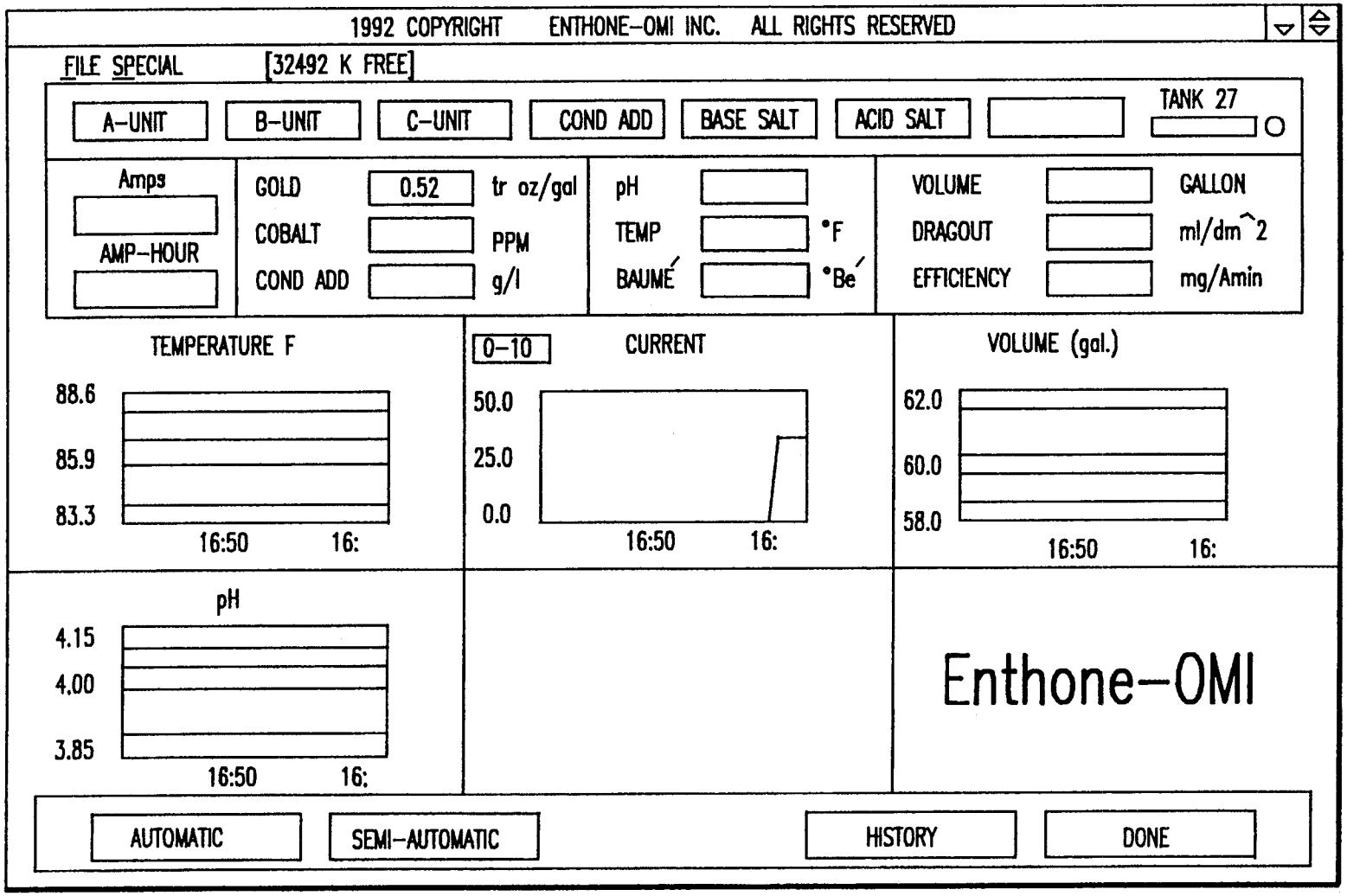
FIG. 5 shows a sample operator display for a hard gold plating process graphically displaying the history of certain plating bath parameters.

Display 44 is coupled to CPU 10 to provide the operator with a current display of the current-time, predicted bath constituent levels, actual bath constituent levels and the required additions. A sample operator display for a hard gold plating bath is shown in FIG. 2. This display shows all setpoint and actual values, pump flowrates, replenisher concentrations, recommended pump-on times in seconds and the actual pump-on times. The display can also provide the above-mentioned diagnostic screens, samples of which are shown in FIGS. 3–5, to assist the operator in bringing the bath parameters back within their desired ranges. The diagnostic capabilities provided by the diagnostic screens and other help screens in plating system setup and maintenance. The operator can manipulate the display screens via operator interface 46, such as a conventional keyboard, mouse, pointer, or the like.

For example, FIG. 3 shows a sample high gold diagnostic screen, and suggests a course of action for the operator to follow to bring the gold concentration back within the desired range. FIG. 4 shows a sample adhesion diagnostic screen, and suggests a course of action for the operator to follow to solve adhesion problems. FIG. 5 shows a sample trend screen showing the automatic sensor strip charts. Each chart shows the setpoint, represented by the center line, upper and lower control limits and the actual measurements. In the example shown in FIG. 5, the pH setpoint is 4.0, the control limits are 3.9 and 4.1, and the actual measurement made by the pH sensor is 4.06.

Figure 6:
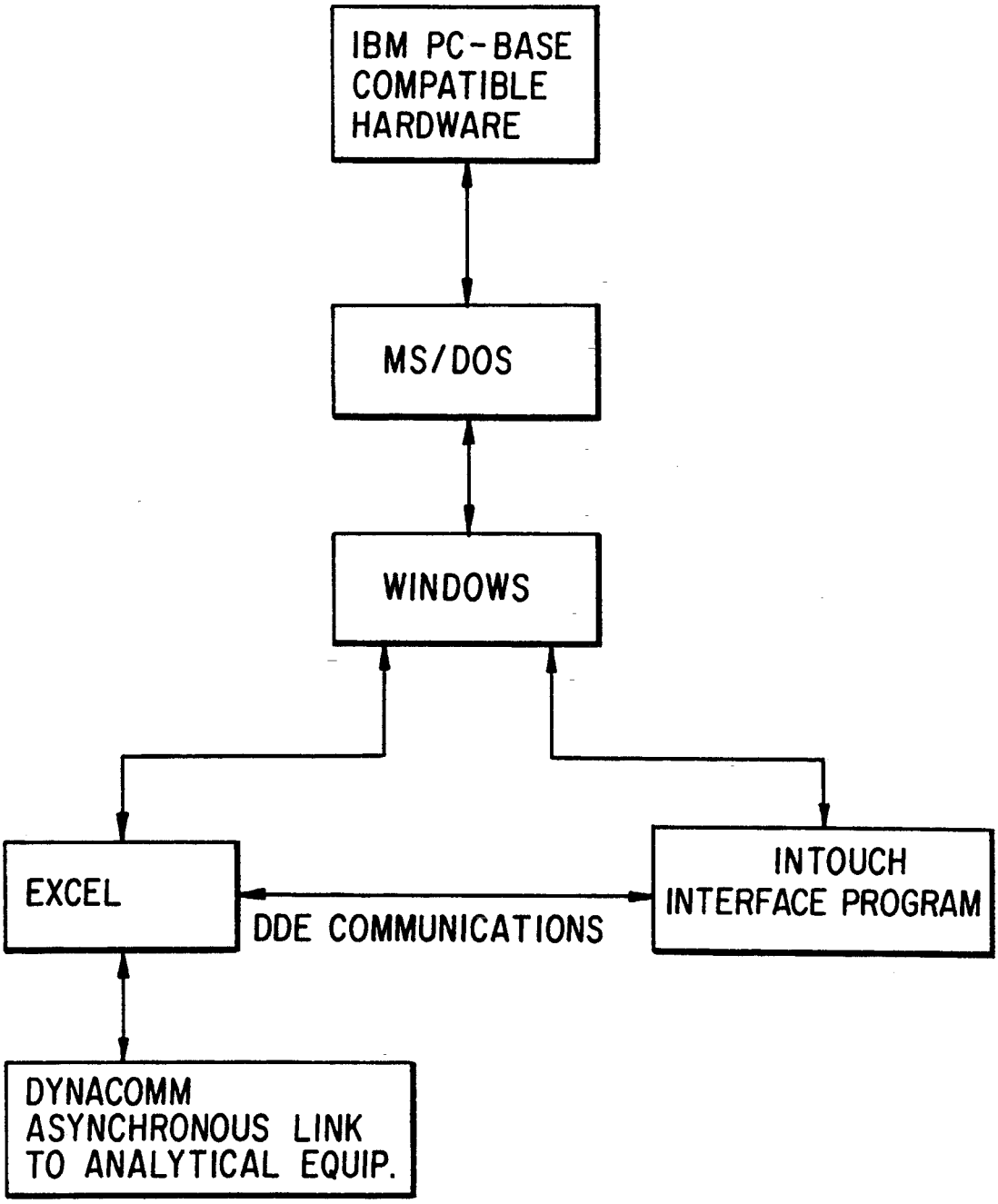
FIG. 6 shows a flow chart of a general overview of the applications software used in a preferred embodiment of the present invention.

In a preferred embodiment, CPU 10 is programmed using off-the-shelf applications software. The feed-forward and feed-backward calculations, along with the sample displays shown in FIGS. 2–5, can be accomplished using Microsoft Windows, Excel, and Wonderware InTouch, as shown in FIG. 6. Alternatively, the software can be directly encoded on a microchip, for example.

The following is an example of the system of the present invention used to control hard gold processes.

Using the applications program Excel 3.0, the following Constants are named (it is to be understood that the term "Constants" is used within the context of the Excel program, and does not mean that they are invariable):

| Chemical | Atomic Weight |
|---|---|
| Gold | 197 |
| Potassium | 39.1 |
| Potassium Oxalate | 184 |
| Potassium Citrate | 306.3 |
| Citric | 192 |
| Oxalic | 126 |
| Hydrogen | 1 |
| g/troy oz | 31.1 |

The constituents of replenishment additions are:

| | g/A unit | g/B unit | g/C unit | per g Cond. add. | per g Base Salt | per g Acid Salt |
|---|---|---|---|---|---|---|
| Gold | 31.3 | 0 | 0 | 0 | 0 | 0 |
| Cobalt | 0 | .212 | 0 | 0 | 0 | 0 |
| Oxalic | 0 | 0 | 22.5 | .6847826 | 0 | 0 |
| Citric | 0 | 0 | 22.5 | 0 | .6268364 | 1 |
| Potassium | 6.1726396 | 0 | 0 | 0.425 | .3829579 | 0 |
| $H^+$ | 0 | 0 | .7087054 | 0 | 0 | .015625 |

The Constants which vary with the process are:

| | Process 1 | Process 2 |
|---|---|---|
| Hardener | Cobalt | Nickel |
| Gold Factor | .7783 | .5833 |
| Hardener Factor | −19.1176 | −9.6224 |
| Citric Factor | 0 | .0393 |
| pH Factor | 41.5832 | 56.2935 |

These factors represent the effect that each parameter has on the overall efficiency of the plating bath. It is assumed that the effects are additive.

The Constants which vary with the application, that is, vary depending on the plating application, are:

| Make-up concentration | Barrel | Rack | Reel-to-Reel | Deep Tank | ATM |
|---|---|---|---|---|---|
| Gold | 4.1 | 8.2 | 24.5 | 4.1 | 13 |
| Hardener | 1 | 1 | 1.5 | 0.5 | 1.5 |
| Cond Add. | 25 | 50 | 50 | 25 | 50 |
| Citric | 129.8 | 129.8 | 129.8 | 129.8 | 129.8 |
| pH | 4 | 4 | 4.4 | 4 | 4.4 |
| Potassium | 60 | 60 | 60 | 60 | 60 |
| Efficiency | 40 | 50 | 50 | 50 | 50 |

The following terms are user definable to set the operating conditions:

| | Units |
|---|---|
| Gold make-up concentration | g/l |
| Hardener make-up concentration | g/l |
| Conducting additive make-up concentration | g/l |
| Percent gold in deposit | % |
| Deposit density | $g/cm^3$ |
| Deposit thickness | μm |
| Drag-out | $mi/dm^2$ |
| Efficiency | mg/A-min |
| Current Density | $A/dm^2$ |
| pH | (conventional scale) |
| Bath volume | liter |

The units in the first column are those used in internal calculations. Preferably, conversion factors are defined so that the output of the calculations can be displayed in other units.

The first step in making the desired replenishment calculations is to calculate the new bath concentrations on the assumption that the process has been run for 1 ampere-minute without any replenishments. Since the efficiency usually varies less than 0.001% over this period, this assumption should be valid.

Intermediate calculations:

$$\text{Plating Rate} = \frac{[\text{Efficiency}]}{[\text{Deposit Density}]\,[\text{Deposit Thickness}]\,[10]}$$

$$\text{Gold Plated} = \frac{[\text{Deposit Density}]\,[\text{Deposit Thickness}]}{[100]}$$

Depletion calculations:

$$\text{Gold Depletion} = [\text{Plating Rate}]\left([\text{Gold Plated}] + \frac{[\text{Gold Conc}]\,[\text{Dragout}]}{[1000]}\right)$$

$$\text{Hardener Depletion} = [\text{Plating Rate}]\left(\frac{[\%\ \text{Hardener}]\,[\text{Gold Plated}]}{[100]} + \frac{[\text{Hardener Conc}]\,[\text{Dragout}]}{[1000]}\right)$$

$$\text{Oxalic Depletion} = [\text{Plating Rate}]\left(\frac{[\text{Gold Plated}]\,[\text{Stoich}]\,[\text{Atomic Weight Oxalic}]\,[60]}{[96.5]\,[2]\,[\text{Efficiency}]} + \frac{[\text{Oxalic Conc}]\,[\text{Dragout}]}{[1000]}\right)$$

$$\text{Potassium Depletion} = [\text{Plating Rate}]\left(\frac{[\text{Potassium Conc}]\,[\text{Dragout}]}{[1000]}\right)$$

-continued $$H^{+}\text{Depletion} = [\text{Plating Rate}]\left(\frac{[\text{Gold Plated}]\,[60]\left(1+\frac{\text{Efficiency}}{122.5}\right)}{[\text{Efficiency}]}+\frac{[H^{+}\text{Conc}]\,[\text{Dragout}]}{[1000]}\right)$$

Δ Concentration calculation
The change in solution concentration due to the depletion is:

$$\Delta\ \text{Concentration} = \frac{[\text{Initial Concentration}]\,[\text{Bath Volume}] - [\text{Depletion}]}{[\text{Bath Volume}]}$$

Replenishment calculation:

$$A\ \text{unit Replenishment} = \frac{[60]\ \text{Bath Volume}]\,[\Delta\ \text{Gold Concentration}]}{[\text{g Gold in 1 } A \text{ unit}]}$$

$$B\ \text{unit Replenishment} = \frac{[60]\,[\text{Bath Volume}]\,[\Delta\ \text{Hardener Concentration}]}{[\text{g Hardener in 1 } B \text{ unit}]}$$

$C$ unit Replenishment =

$$\text{A)}\ \frac{[60]\,[\text{Bath Volume}]\,[\Delta\ \text{Oxalic Concentration}]}{[\text{g Oxalic in 1 } C \text{ unit}]}$$

$$\text{B)}\ \frac{[60]\,[\text{Bath Volume}]\,[\Delta\ \text{Citric Concentration}]}{[\text{g Citric in 1 } C \text{ unit}]}$$

$$\text{C)}\ \frac{[60]\,[\text{Bath Volume}]\,[\Delta\ H^{+}\ \text{Concentration}]}{[\text{g } H^{+} \text{ in 1 } C \text{ unit}]}$$

Recommended replenishment is the minimum of $A$, $B$, $C$.
Conducting Additive Replenishment =

$$\frac{[60]\left([\text{Bath Volume}]\,[\Delta\ \text{Oxalic Concentration}] - \frac{[\text{g Oxalic in 1 } C \text{ unit}]\,[C \text{ units Replenished}]}{[60]}\right)}{\frac{[\text{Atomic Weight Oxalic}]}{[\text{Atomic Weight Potassium Oxalate}]}}$$

Base Salt Replenishment =

$$\frac{[60]\left([\text{Volume}]\,[\Delta\ K\ \text{Conc}] - \frac{[\text{g } K \text{ in 1 } A \text{ unit}]\,[A \text{ units Replenished}] + [\text{g } K \text{ in 1 g } CA]\,[CA \text{ replenished}]}{[60]}\right)}{[\text{g Potassium in 1 g Base Salt}]}$$

Acid Salt Replenishment =

$$\frac{[60]\left([\text{Bath Volume}]\,[\Delta\ H^{+}\ \text{Concentration}] - \frac{[\text{g } H^{+} \text{ in 1 } C \text{ unit}]\,[C \text{ units Replenished}]}{[60]}\right)}{[\text{g } H^{+} \text{ in 1 g Acid Salt}]}$$

Actual Addition Rates and Addition Frequencies are entered for each replenishment chemical. The solutions are depleted according to the above Depletion formulae, and replenished according to the given Rates and Frequencies. Replenishment additions and the solution concentrations are correlated according to the Constituents of replenishment additions table found above.

Updating operation parameters:

$$\text{New pH} = [\text{Old pH}] - \text{LOG}\left(\frac{[\text{New } H^{+}\ \text{Concentration}]}{[\text{Old } H^{+}\ \text{Concentration}]}\right)$$

$$\begin{aligned}\text{New Efficiency} = {} & [\text{Old Efficiency}] - \\ & [\text{Gold Factor}]\,[\Delta\ \text{Gold Conc}] - \\ & [\text{Hardener Factor}]\,[\Delta\ \text{Hardener Conc}] - \\ & [\text{Oxalic Factor}]\,[\Delta\ \text{Oxalic Conce}] - \\ & [\text{Citric Factor}]\,[\Delta\ \text{Citric Conc}] - [\text{pH Factor}]\,[\Delta\text{pH}]\end{aligned}$$

-continued $$\text{New Plating Rate} = \frac{[\text{New Efficiency}]}{[\text{Deposit Density}]\,[\text{Dpeosit Thickness}]\,[10]}$$

New Thickness$^{+}$ =

$$\frac{1}{[10]\,[\text{Deposit Density}]}\left(\frac{[\text{New Efficiency}]}{[\text{Initial Plating Rate}]}\right)$$

The new values for solution concentrations, Plating Rate, Efficiency, and the like, are used to calculate further depletions. This loop is repeated, preferably 60 times. A "scale factor" is preferably introduced to allow the time period of the plot to be changed, which changes the time period between iterations. Miscellaneous statistics can be calculated using standard Excel functions.

The term "Deposit Thickness" used above refers to the desired thickness to be plated on a piece. The term "Thickness" which appears in the display, equals the thickness plated in 1 ampere-minute multiplied by the number of ampere-minutes necessary to plated the desired thickness on a piece. The number of ampere-minutes required is determined from the initial Efficiency, and the changes in "Thickness" reflect changes in the Efficiency over time.

In another preferred embodiment of the present invention, a single CPU 10 is used to multitask between a plurality of plating lines, as generally shown in FIG. 6. In this Figure, the sensor readings have been generically shown as input along lines 38A, 40A, 38B, 40B, and it is understood that these sensor reading may include data from a temperature sensor, liquid level sensor, pH sensor and autotitrator, and the like, as shown in FIG. 1. Also, an efficiency sensor may be used to provide bath efficiency data to the chemical feeder to be forwarded to the CPU, as shown in FIG. 1. Additionally, the replenishment additions from chemical feeders 12A, 12B are generically shown at 42A, 42B.

Figure 7:
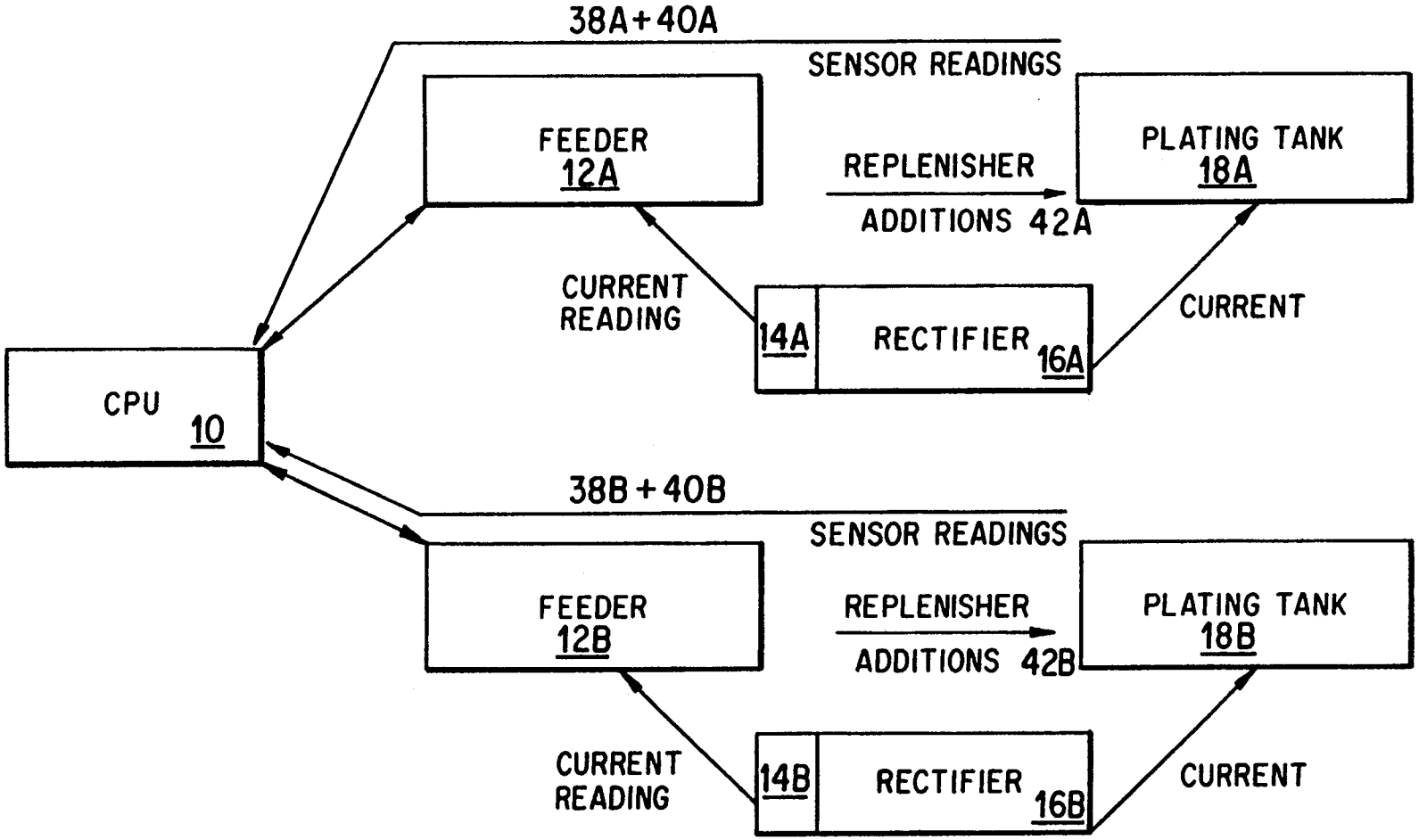
FIG. 7 is a schematic drawing showing a single CPU controlling a plurality of plating baths according to another preferred embodiment of the present invention.

As shown in FIG. 7, a plurality of chemical feeders 12A, 12B may be used. However, it is also envisioned that a single chemical feeder having multiple pumps may also be used. Of course, the invention is not limited to controlling two plating baths, and a single CPU may control as many baths as the computing capacity of the CPU can handle.

The above is for illustrative purposes only. Modification can be made, especially with regard to size, shape and arrangement of parts, within the scope of the invention as defined by the appended claims.

We claim:

1. A system for controlling a plating process, said system comprising:

calculating means for calculating a predictive system model of a plating bath and calculating expected replenishment additions of at least one bath constituent based on said predictive system model; and sensor means for sensing at least one predetermined bath parameter indicative of the progress of the plating process;

wherein said calculating means calculates actual replenishment additions by modifying said expected replenishment additions based on the signal from said sensor means.

2. A system as in claim 1, further comprising automatic replenisher means for automatically making said actual replenishment additions based on a signal from said calculating means.

3. A system as in claim 1, wherein said expected replenishment additions are based on mass balance equations applied to said predictive system model as a function of current-time.

4. A system as in claim 3, wherein said predictive system model is based on a predictive model of changes in composition of a plating bath due to anode and cathode reactions and drag-out.

5. A system for controlling a plating process, said system comprising:

calculating means for calculating expected replenishment additions of at least one bath constituent of a plating bath; and sensor means for sensing at least one predetermined bath parameter indicative of the progress of the plating process, wherein said sensor means includes an autotitrator and efficiency meter;

wherein said calculating means calculates actual replenishment additions by modifying said expected replenishment additions based on the signal from said sensor means.

6. A system as in claim 5, further comprising a chemical feeder for automatically feeding said actual replenishment additions to the plating bath, wherein a signal indicative of bath efficiency is sent from said efficiency meter to said calculating means via said chemical feeder, said signal being continuously updated.

7. A system as in claim 5, wherein said sensor means further includes a temperature sensor for sensing the temperature of the plating bath, a liquid volume sensor for sensing the liquid volume of the plating bath, and a pH sensor for sensing the pH of the plating bath, wherein signals from said temperature sensor, said liquid volume sensor and said pH sensor are sent directly to said calculating means.

8. A system as in claim 7, wherein said calculating means includes a CPU.

9. A system as in claim 8, further comprising a display for providing a display of the current-time, predicted bath constituent levels, actual bath constituent levels and the next expected replenishment additions.

10. A system as in claim 9, further comprising operator input means for inputing corrected actual replenishment additions.

11. A system for automatically controlling the composition of a plating bath, said system comprising:

feed-forward control means for determining a predicted replenishment addition to the plating bath based on a predictive model;

feed-backward control means for modifying the predicted replenishment addition based on at least one bath parameter to determine an actual replenishment addition; and automatic feed means for automatically feeding said actual replenishment addition into the plating bath.

12. A system as in claim 11, wherein the predicted replenishment addition is updated after each actual replenishment addition is fed to the plating bath.

13. A system as in claim 12, wherein said predicted replenishment addition and said actual replenishment addition are calculated as a function of current-time.

14. A method of controlling a plating bath, said method comprising the steps of:

calculating a predictive model of the changes in composition of a plating bath as a function of current-time to determine an amount and timing of a predicted replenisher addition for at least one bath constituent;

measuring at least one bath parameter indicative of the changes in composition of the plating bath;

calculating an amount and timing of an actual replenisher addition by modifying said predicted replenisher addition according to the measured at least one bath parameter.

15. A method as in claim 14 further comprising the step of automatically adding said actual replenisher addition to the plating bath.

16. A method as in claim 15, further comprising the step of updating said predicted replenisher addition and said actual replenisher addition after automatically adding said actual replenisher addition.

17. A method as in claim 14, wherein said predictive model is calculated based on changes caused by anode and cathode reactions and changes caused by drag-out.

18. A method as in claim 14, wherein materials balance calculations are applied to said predictive model to determine the amount and timing of predicted replenisher additions.

19. A method as in claim 14, wherein said step of measuring at least one bath parameter includes measuring the efficiency of the plating bath and the concentration of at least one bath constituent.

20. A method as in claim 19, wherein said step of measuring at least one bath parameter further includes measuring the temperature of the plating bath, the liquid volume of the plating bath and the pH of the plating bath.

* * * * *

UNITED STATES PATENT AND TRADEMARK OFFICE

CERTIFICATE OF CORRECTION

PATENT NO. : 5,368,715

DATED : November 29, 1994

INVENTOR(S) : Michael P. Hurley and Stephen J. Boezi

It is certified that error appears in the above-indentified patent and that said Letters Patent is hereby corrected as shown below:

Columns 5 and 6, line 53, under the Oxalic Depletion formula, insert the following:

$$\text{Citric Depletion} = [\text{Plating Rate}]\left(\frac{[\text{Gold Plated}]\,[1\text{-Stoich}]\,[\text{Atomic Weight Citric}]\,[60]}{[96.5]\,[3]\,[\text{Efficiency}]} + \frac{[\text{Citric Conc}]\,[\text{Dragout}]}{[1000]}\right)$$

Column 7, line 49, above the line starting with "Actual Addition Rates...", insert --Iteration-- as a heading.

Column 9, line 3, delete "plated" and insert therfor --plate--.

Column 10, line 24, delete "inputing" and insert therefor --inputting--.

Signed and Sealed this

Eighteenth Day of April, 1995

Bruce Lehman

*Attest:*

BRUCE LEHMAN

*Commissioner of Patents and Trademarks*

*Attesting Officer*